US005810316A

United States Patent [19]

Eby

[11] Patent Number: 5,810,316

[45] Date of Patent: Sep. 22, 1998

[54] ADJUSTABLE AND COLLAPSIBLE BOOK STAND

[76] Inventor: Thomas L. Eby, 7730 Geierman Rd., Maybee, Mich. 48159

[21] Appl. No.: 764,067

[22] Filed: Nov. 6, 1996

[51] Int. Cl.[6] ..... A47B 97/04

[52] U.S. Cl. ..... 248/451; 248/456

[58] Field of Search ..... 248/451, 445, 248/449, 452, 456, 464

[56] References Cited

U.S. PATENT DOCUMENTS 4,323,214 4/1982 DeLuca ..... 248/456
4,555,128 11/1985 White et al. ..... 248/451
5,042,771 8/1991 Demarest, Jr. ..... 248/451
5,580,024 12/1996 Brice ..... 248/451

*Primary Examiner*—Leslie A. Braun
*Assistant Examiner*—Willie Berry, Jr.

[57] ABSTRACT

A new Adjustable and Collapsible Book Stand for adjustably supporting various sizes of books and retaining the pages in the desired position thereby freeing the user's hands. The inventive device includes a support member, an adjustable tilt support means pivotally secured to the support member, and at least one adjustable page retaining means slidably secured to the breech of the support member to engage the desired pages of various sizes of books.

7 Claims, 3 Drawing Sheets

FIG 3
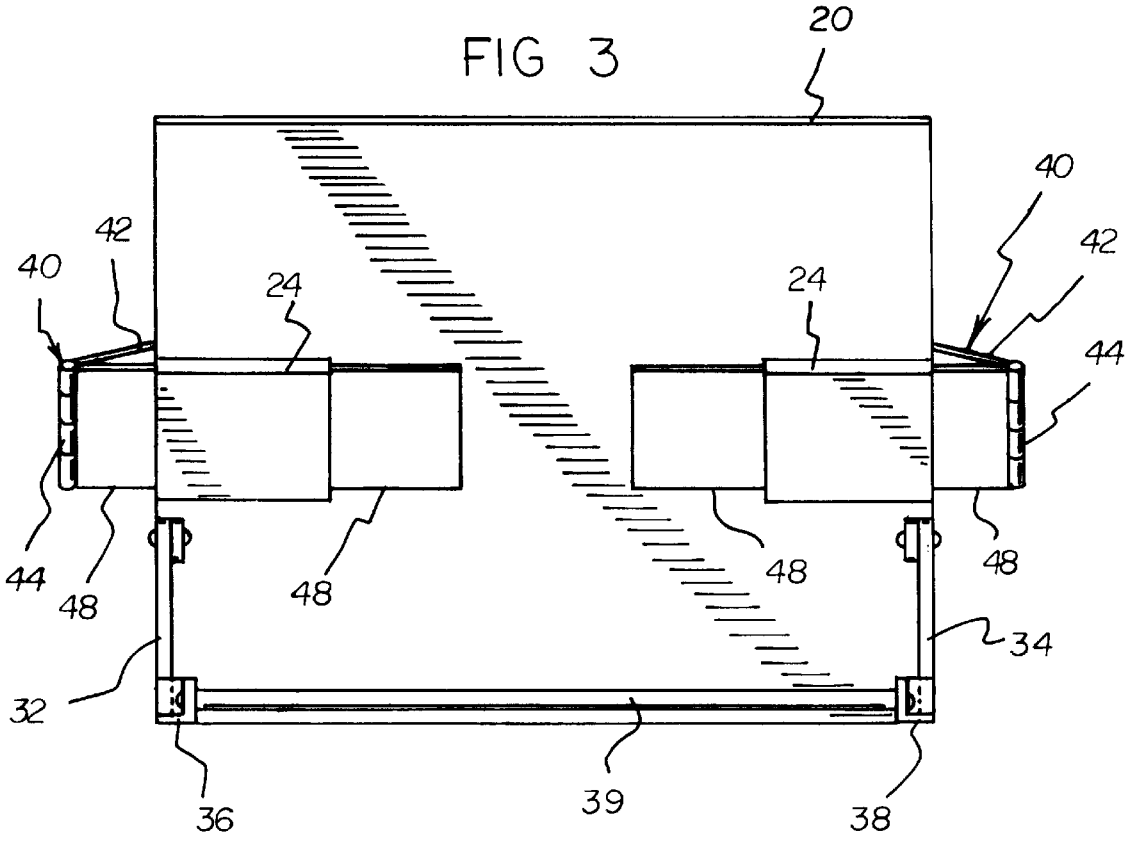
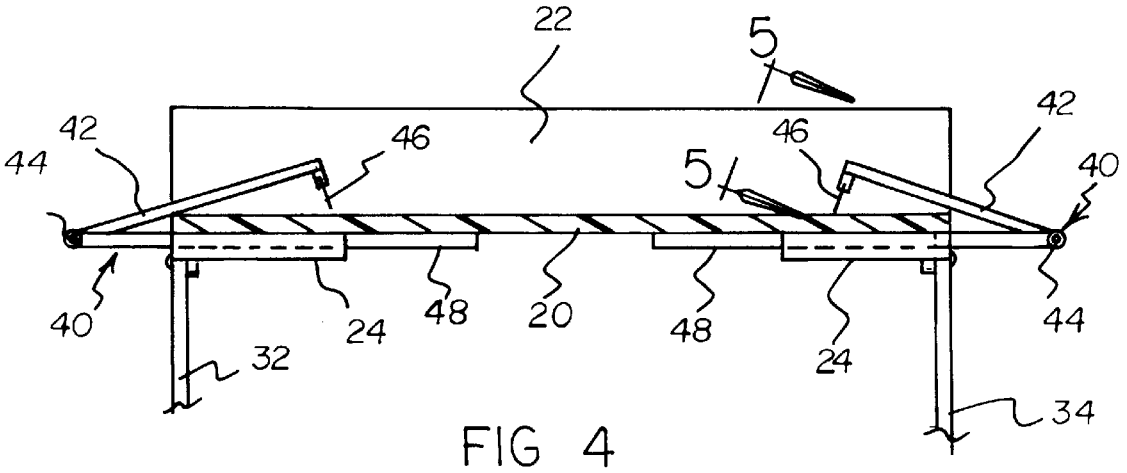
FIG 4

ADJUSTABLE AND COLLAPSIBLE BOOK STAND

BACKGROUND OF THE INVENTION

1. Field of the Invention

The present invention relates to Collapsible Book Stands and more particularly pertains to a new Adjustable and Collapsible Book Stand for adjustably supporting various sizes of books and retaining the pages in the desired position thereby freeing the user's hands.

2. Description of the Prior Art

The use of Collapsible Book Stands is known in the prior art. More specifically, Collapsible Book Stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art Collapsible Book Stands include U.S. Pat. No. 5,025,353; U.S. Pat. No. 5,035,393; U.S. Pat. No. 4,116,413; U.S. Pat. No. 5,067,682; U.S. Pat. No. 4,679,757 and U.S. Pat. No. 4,553,728.

While these devices fulfill their respective, particular objectives and requirements, the aforementioned patents do not disclose a new Adjustable and Collapsible Book Stand. The inventive device includes a support member, an adjustable tilt support means pivotally secured to the support member, and at least one adjustable page retaining means slidably secured to the breech of the support member to engage the desired pages of various sizes of books.

In these respects, the Adjustable and Collapsible Book Stand according to the present invention substantially departs from the conventional concepts and designs of the prior art, and in so doing provides an apparatus primarily developed for the purpose of adjustably supporting various sizes of books and retaining the pages in the desired position thereby freeing the user's hands.

SUMMARY OF THE INVENTION

In view of the foregoing disadvantages inherent in the known types of Collapsible Book Stands now present in the prior art, the present invention provides a new Adjustable and Collapsible Book Stand construction wherein the same can be utilized for adjustably supporting various sizes of books and retaining the pages in the desired position thereby freeing the user's hands.

The general purpose of the present invention, which will be described subsequently in greater detail, is to provide a new Adjustable and Collapsible Book Stand apparatus and method which has many of the advantages of the Collapsible Book Stands mentioned heretofore and many novel features that result in a new Adjustable and Collapsible Book Stand which is not anticipated, rendered obvious, suggested, or even implied by any of the prior art Collapsible Book Stands, either alone or in any combination thereof.

To attain this, the present invention generally comprises a support member, an adjustable tilt support means pivotally secured to the support member, and at least one adjustable page retaining means slidably secured to the breech of the support member to engage the desired pages of various sizes of books.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable and Collapsible Book Stand apparatus and method which has many of the advantages of the Collapsible Book Stands mentioned heretofore and many novel features that result in a new Adjustable and Collapsible Book Stand which is not anticipated, rendered obvious, suggested, or even implied by any of the prior art Collapsible Book Stands, either alone or in any combination thereof.

It is another object of the present invention to provide a new Adjustable and Collapsible Book Stand which may be easily and efficiently manufactured and marketed.

It is a further object of the present invention to provide a new Adjustable and Collapsible Book Stand which is of a durable and reliable construction.

An even further object of the present invention is to provide a new Adjustable and Collapsible Book Stand which is susceptible of a low cost of manufacture with regard to both materials and labor, and which accordingly is then susceptible of low prices of sale to the consuming public, thereby making such Adjustable and Collapsible Book Stand economically available to the buying public.

Still yet another object of the present invention is to provide a new Adjustable and Collapsible Book Stand which provides in the apparatuses and methods of the prior art some of the advantages thereof, while simultaneously overcoming some of the disadvantages normally associated therewith.

Still another object of the present invention is to provide a new Adjustable and Collapsible Book Stand for adjustably supporting various sizes of books and retaining the pages in the desired position thereby freeing the user's hands.

Yet another object of the present invention is to provide a new Adjustable and Collapsible Book Stand which includes a support member, an adjustable tilt support means pivotally secured to the support member, and at least one adjustable page retaining means slidably secured to the breech of the support member to engage the desired pages of various sizes of books.

Still yet another object of the present invention is to provide a new Adjustable and Collapsible Book Stand that allows the reader's hands to remain free to do other things.

Even still another object of the present invention is to provide a new Adjustable and Collapsible Book Stand that supports various sizes of books and which has spring hinge arms near the sides which grasp the pages being read and easily allow the pages to be turned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear view of the present invention.

FIG. 4 is a cross sectional view taken along line 4—4 of FIG. 2.

DESCRIPTION OF THE PREFERRED EMBODIMENT

Figure 1:
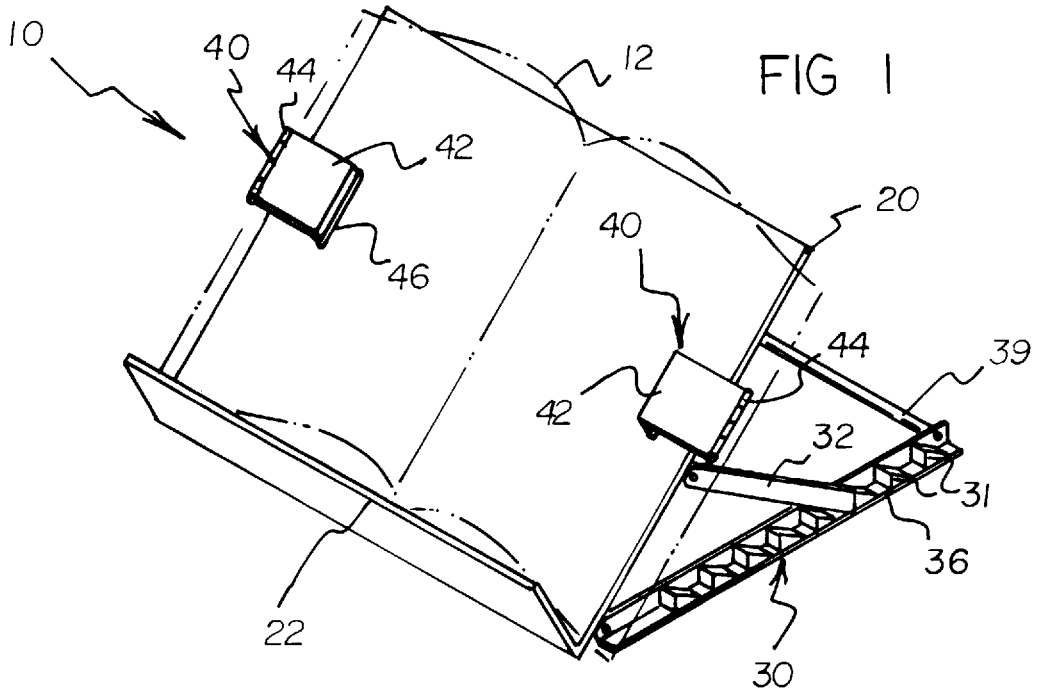
FIG. 1 is a upper side perspective view of a new Adjustable and Collapsible Book Stand according to the present invention.

With reference now to the drawings, and in particular to FIGS. 1 through 6 thereof, a new Adjustable and Collapsible Book Stand embodying the principles and concepts of the present invention and generally designated by the reference numeral 10 will be described.

More specifically, it will be noted that the Adjustable and Collapsible Book Stand 10 comprises a support member 20 substantially swaged having two vertical sides, an adjustable tilt support means 30 pivotally secured to the support member 20 providing adjustable vertical and horizontal support for the support member 20, and at least one adjustable page retaining means 40 adjustably secured to the vertical side, where the adjustable page retaining means 40 engages the desired edge of a page being read.

Figure 2:
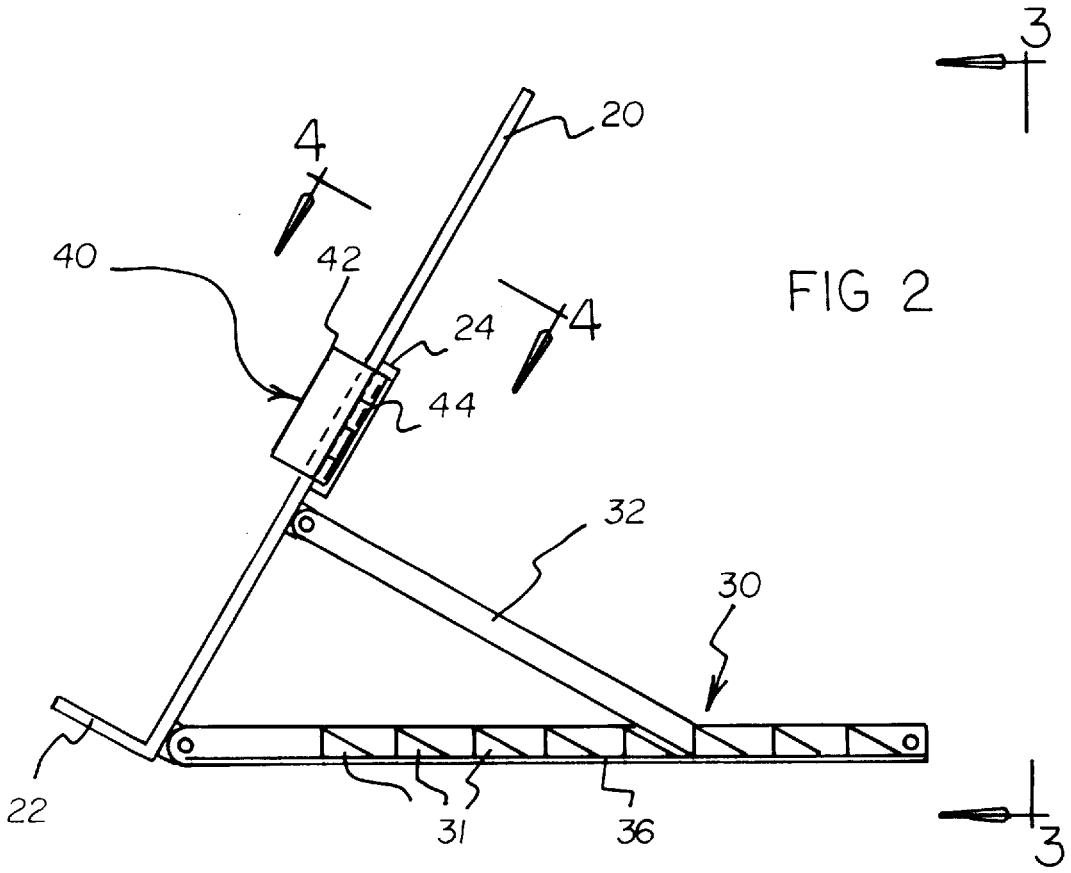
FIG. 2 is a side view of the present invention.
Figure 5:
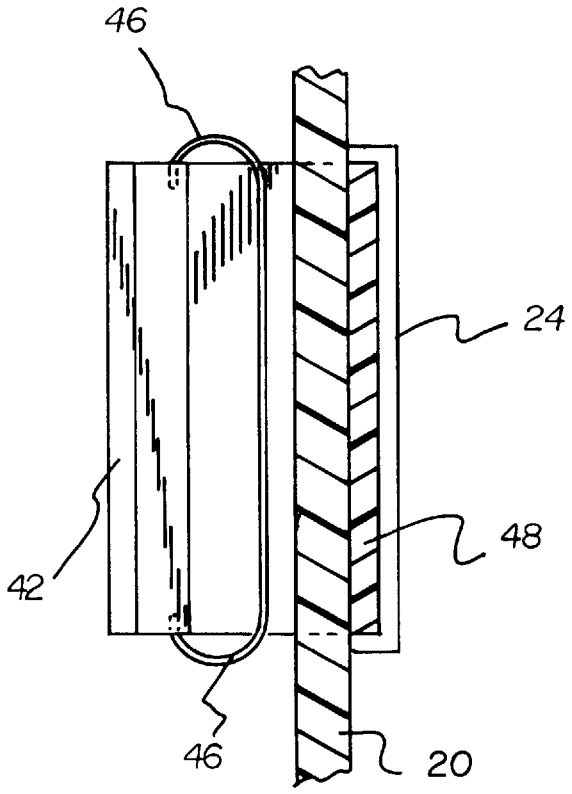
FIG. 5 is a cross sectional view taken along line 5—5 of FIG. 4.
Figure 6:
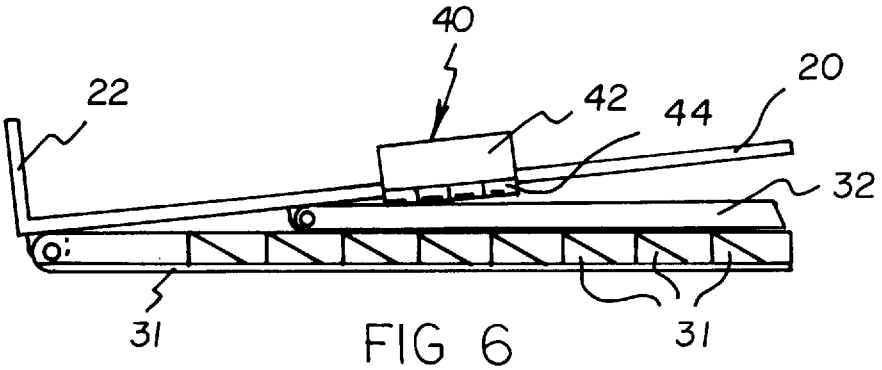
FIG. 6 is a side view of the present invention in the storage position.

As best illustrated in FIGS. 1, it can be shown that a lip 22 is secured to the lower portion of the support member 20. As shown in FIGS. 3–5, the adjustable page retaining means 40 has a width adjusting arm 48 slidably secured to the breech of the support member 20 by a support sleeve 24 secured to the breech of the support member 20 allowing horizontal adjustment. A spring hinge 44 is secured to the end of the width adjusting arm 48 farthest from the concentric of the support member 20. An L-shaped member 42 has a unnumbered lip portion. The end opposite of the unnumbered lip portion is secured to the spring hinge 44 opposite of the width adjusting member as best shown in FIG. 4 of the drawings. The unnumbered lip portion of the L-shaped member 42 removably engages the frontal portion of the page preventing the page from turning. Preferably as shown in FIGS. 4 and 5, a spring wire 46 is secured to the unnumbered lip portion springly engaging the frontal surface of the page allowing easier removal of the page while simultaneously providing adequate frictional engagement to prevent movement of the page unintentionally. The adjustable tilt support means 30 has a first leg 36 and a second leg 38 pivotally secured to the support member 20 opposite of one another near the lower corners extending substantially orthogonal to the support member 20. As shown in FIGS. 1 and 3, a support rod 39 is secured mesial or between the first and second legs 36, 38 opposite of the support member 20. A plurality of syncline shaped or V members 31 are secured to an upper surface of the first and second legs 36, 38 as best shown in FIGS. 2 and 6 of the drawings. A first and second support arm 32, 34 are pivotally secured to the support member 20 opposite of one another near the upper corners extending downwardly to removably engage a selected syncline shaped member 31 of the corresponding first or second leg 36, 38.

In use, the user adjusts the adjustable tilt support means 30 to provide the desired angle for the support member 20. A book 12 is positioned on the support member 20. The adjustable page retaining means 40 is horizontally adjusted to the width of the book 12. The spring wire 46 engages the front surface of the page during operation to retain the page in the desired position. When the user desires to turn the page, the user simply manually manipulates the page easily from under the spring wire 46 and positions the page under the opposite spring wire 46. When finished utilizing the invention, the adjustable tilt support means 30 is manipulated to prevent engagement with the syncline shaped members 41, thereby allowing the support member 20 to be rotated into a substantially swaged storage position with the first and second legs 36, 38.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable and collapsible book stand comprising:

a support member having two vertical sides;

an adjustable tilt support means pivotally secured to said support member providing adjustable vertical and horizontal support for said support member;

at least one adjustable page retaining means adjustably secured to said vertical side, wherein said adjustable page retaining means is adapted to engage the edge of a page being read; and said adjustable page retaining means includes:

a width adjusting arm slidably secured to the breech of said support member by a support sleeve secured to the breech of said support member allowing horizontal adjustment;

a spring hinge secured to an end of said width adjusting arm; and an L-shaped member having a lip portion, where an end of the lip-shaped member opposite of the lip portion is secured to said spring hinge, where the lip portion of said L-shaped member is adapted to removably engage a frontal portion of the page.

2. The adjustable and collapsible book stand of claim 1, wherein a lip is secured to a lower portion of said support member.

3. The adjustable and collapsible book stand of claim 1, wherein a spring wire is secured to said lip portion and is adapted to springingly engage the frontal surface of said page.

4. The adjustable and collapsible book stand of claim 1, wherein said adjustable tilt support means includes:

a first and second leg pivotally secured to said support member opposite of one another near lower corners extending substantially orthogonal to said support member;

a support rod secured between said first and second legs opposite of said support member;

a plurality of V-shaped members secured to an upper surface of said first and second legs; and a first and second support arm pivotally secured to said support member opposite of one another near upper corners extending downwardly to removably engage a selected V-shaped member of the corresponding first or second leg.

5. An adjustable and collapsible book stand comprising:

a support member having two vertical sides and a lip secured to a lower portion;

an adjustable tilt support means pivotally secured to said support member providing adjustable vertical and horizontal support for said support member;

at least one adjustable page retaining means adjustably secured to said vertical side, where said adjustable page retaining means is adapted to engage the desired edge of a page being read;

a lip is secured to the lower portion of said support member; and said adjustable page retaining means includes:

a width adjusting arm slidably secured to the breech of said support member by a support sleeve secured to the breech of said support member allowing horizontal adjustment;

a spring hinge secured to an end of said width adjusting arm; and an L-shaped member having a lip portion, where an end opposite of the lip portion is secured to said spring hinge, where the lip portion of said L-shaped member is adapted to removably engage a frontal portion of the page.

6. The adjustable and collapsible book stand of claim 5, wherein a spring wire is secured to said lip portion springingly engaging the frontal surface of said page.

7. The adjustable and collapsible book stand of claim 5, wherein said adjustable tilt support means includes:

a first and second leg pivotally secured to said support member opposite of one another near lower corners extending substantially orthogonal to said support member;

a support rod secured between said first and second legs opposite of said support member;

a plurality of V-shaped members secured to an upper surface of said first and second legs; and a first and second support arm pivotally secured to said support member opposite of one another near upper corners extending downwardly to removably engage a selected V-shaped member of the corresponding first or second leg.

* * * * *